United States Patent [19]

Yeadon

[11] Patent Number: 5,074,074

[45] Date of Patent: Dec. 24, 1991

[54] COMPACT GUN UNPLUGGING DEVICE

[76] Inventor: Alan W. Yeadon, P.O. Box 624, Harvard, Ill. 60033

[21] Appl. No.: 606,765

[22] Filed: Oct. 31, 1990

[51] Int. Cl.[5] ..... F41A 29/02

[52] U.S. Cl. ..... 42/95; 242/96

[58] Field of Search ..... 42/95; 242/96, 84.8; 15/104.062, 104.165, 104.16

[56] References Cited

U.S. PATENT DOCUMENTS

| | | | |
|---|---|---|---|
| 2,749,565 | 6/1956 | Stamm, Jr. | 242/84.8 |
| 2,800,289 | 7/1957 | Stamm, Jr. | 42/95 |
| 2,897,525 | 8/1959 | Goodwin et al. | 42/95 |
| 3,078,058 | 2/1963 | Roe | 242/84.8 |
| 4,200,249 | 4/1980 | Synstelien et al. | 242/96 |
| 4,399,627 | 8/1983 | Malesky et al. | 42/95 |
| 4,434,953 | 3/1984 | Czerwinski et al. | 242/848 |
| 4,716,673 | 1/1988 | Williams et al. | 42/95 |
| 4,776,125 | 10/1988 | Black et al. | 42/95 |
| 4,803,792 | 2/1989 | Brown, Jr. et al. | 42/95 |

*Primary Examiner*—Michael J. Carone

[57] ABSTRACT

A gun barrel cleaner comprised of an enclosed spool (150) which is made of two housings (10) and (60) that snap together and can spin freely beside one another. A wire rope (126) is attached to one housing (10) of the enclosed spool (150) and is fed through the other housing (60). A connector (110) is secured to the end of the wire rope (126) to allow for a cleaning attachment (120) to be used to clean the gun barrel.

20 Claims, 3 Drawing Sheets

COMPACT GUN UNPLUGGING DEVICE

BACKGROUND—FIELD OF INVENTION

This invention relates to gun barrel cleaners, specifically to pocket sized gun barrel cleaners which are used in the field.

BACKGROUND—DESCRIPTION OF PRIOR ART

When a sportsman is hunting, he sometimes will lose his footing and accidentally slip, sticking the muzzle of his gun into snow or mud. The most desirable thing for the hunter to do is to unplug the gun right on the spot and continue hunting. Firing a plugged firearm is dangerous because the explosive forces may cause the barrel to be damaged or rupture, allowing metal fragments to be discharged in undesirable directions possibly causing injury.

Some prior art attacks the problem of having a dirty firearm in the field. U.S. Pat. No. 4,716,673 to Williams et al (1988) demonstrates the advantage of using a flexible shaft which can be wound up to reduce its carrying size. It also shows the need for an enclosed case to carry a wound up flexible shaft. An enclosed case is necessary since a flexible shaft tends to straighten out. One problem with the invention of U.S. Pat. No. 4,716,673 to Williams et al (1988) is that in order to clean the gun, the container must be opened and the proper cleaning attachments must be placed on the end of the flexible shaft before it can be used. Another problem is that after use, the flexible shaft must be coiled and replaced by pushing it into the container. Yet another problem is that when the container is opened and the cleaning attachments are being placed on the shaft, there are two pieces of the container which need to be placed somewhere so that the rest of the attachments inside the container don't fall onto the ground.

U.S. Pat. No. 4,776,125 to Black et al (1988) attacks the problem of pushing a flexible shaft into an enclosed container by winding it onto a spool with a pair of flange ends. The problem it fails to overcome is that many flexible shafts of sufficient strength to run a cleaning attachment through a gun barrel will not retain a coiled position. This spool does not allow for a way to prevent the uncoiling of the flexible shaft.

U.S. Pat. No. 4,803,792 to Brown, Jr. et al (1989) attacks the problem of cleaning a gun barrel from the muzzle into the breech. This method of cleaning is a problem because contaminants will be pushed into the action (firing mechanism) and may foul it up. One problem with this invention is that a rigid rod is not practical for use in the field. Another problem is that a rigid rod cannot be pushed through the barrel of a gun from the breech of a lever action or semi-automatic firearm.

Two popular field cleaning kits for firearms which are on the market at the time of this application contain flexible shafts, cleaning attachments, and a chemical solution to clean the bore. The problems with multiple pieces in a cleaning kit have already been discussed. Another problem with these kits is that some game animals (Whitetail Deer for example) have a very keen sense of smell. Firearm cleaning chemicals have very strong odors and game animals will avoid anything that is abnormal in their environment. Use of chemical treatments will warn animals of your existence in their native environment.

Another cleaner on the market consists of a flexible shaft and a couple cleaning attachments. This cleaner needs to be coiled by interweaving the cable with itself so that it doesn't uncoil. It has no container to keep the cable coiled. This coiling method doesn't coil the cable into as small of a diameter as necessary to fit inside a coat pocket. This gives a large coil that is difficult to carry and is cumbersome to uncoil and recoil. Another problem with this cleaner is that it doesn't provide a way to pull tightly fitting cleaning attachments (i.e. a bronze bristle brush which is necessary for a good thorough cleaning) without pulling on the cable itself. Pulling on a cable itself is difficult unless it is wrapped around the user's hand; then it is painful.

OBJECTS AND ADVANTAGES

Accordingly, several objects and advantages of my invention are:

(a) to provide a gun barrel cleaner which can be used to *unplug a gun from the breech*, therefore not pushing contaminants into the action;

(b) to provide a gun barrel cleaner which is *compact and lightweight* so that it can be carried in a sportsman's coat pocket;

(c) to provide a gun barrel cleaner that *can be used as one piece* so that the user doesn't need to set anything on the ground while cleaning his gun;

(d) to provide a gun barrel cleaner that can *easily and quickly coil* and uncoil a flexible shaft into a small enclosed spool;

(e) to provide a gun barrel cleaner that can easily be used to *pull a tightly fitting cleaning attachment* through a gun barrel.

(f) to provide a gun barrel cleaner that is essentially *odorless.*

Further objects and advantages of my invention will become apparent from a consideration of the drawings and ensuing description of it.

DRAWING FIGURES

Figure 3A:
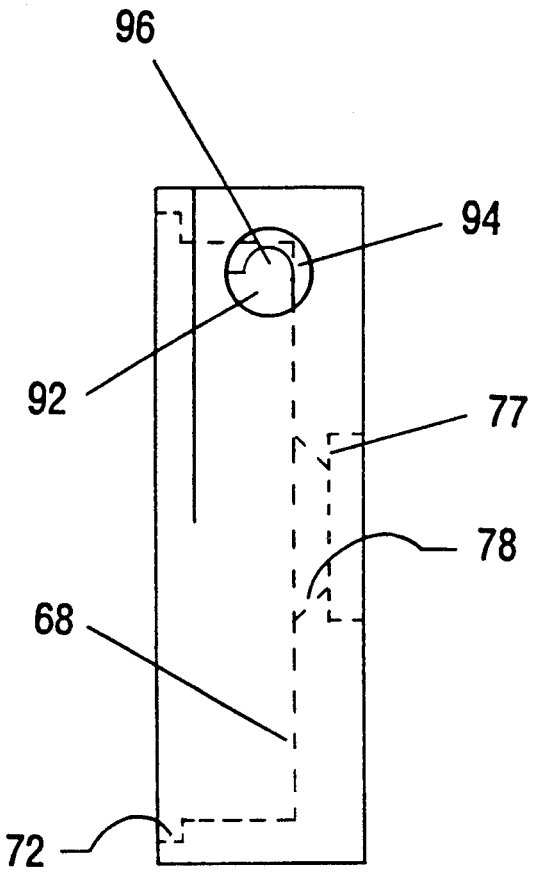
Figure 3B:
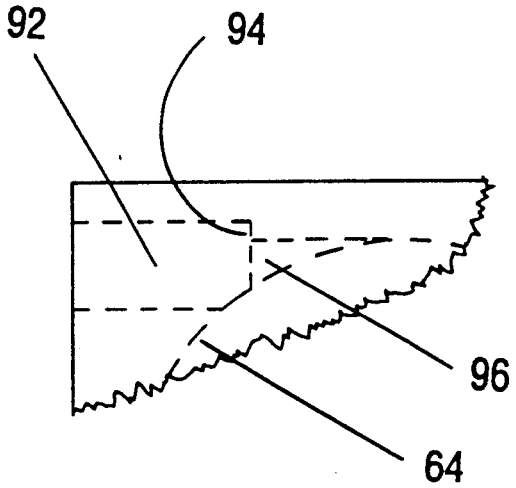

FIGS. 3*a* and 3*b* show two engineering views of the female housing.

REFERENCE NUMERALS IN DRAWINGS

| | | | |
|---|---|---|---|
| 10 | male housing | 14 | back wall |
| 18 | cylinder wall | 22 | lip |
| 26 | barrel wall | 30 | thin slot |
| 34 | wide slot | 38 | tab support |
| 42 | tab | 44 | securing cavern |
| 46 | securing cavern wall | 50 | pathway |
| 60 | female housing | 64 | cylinder wall |
| 68 | back wall | 69 | squared off portion of back wall |
| 72 | lip | 76 | tab entrance hole |
| 77 | tab retaining lip | 78 | angled wall |
| 80 | horizontal tangent wall | 84 | front of squared off section |
| 88 | vertical tangent wall | 92 | entrance cavern |
| 94 | connector stop | 96 | pathway |
| 110 | connector | 112 | internal threads |
| 113 | internal diameter | 116 | retainer |
| 118 | internal diameter | 120 | cleaning attachment |
| 122 | external threads | 126 | plastic coated wire rope |
| 128 | stripped off length | 130 | stripped off length |
| 150 | enclosed spool | | |

DESCRIPTION FIGS. 1 TO 3

Figure 1:
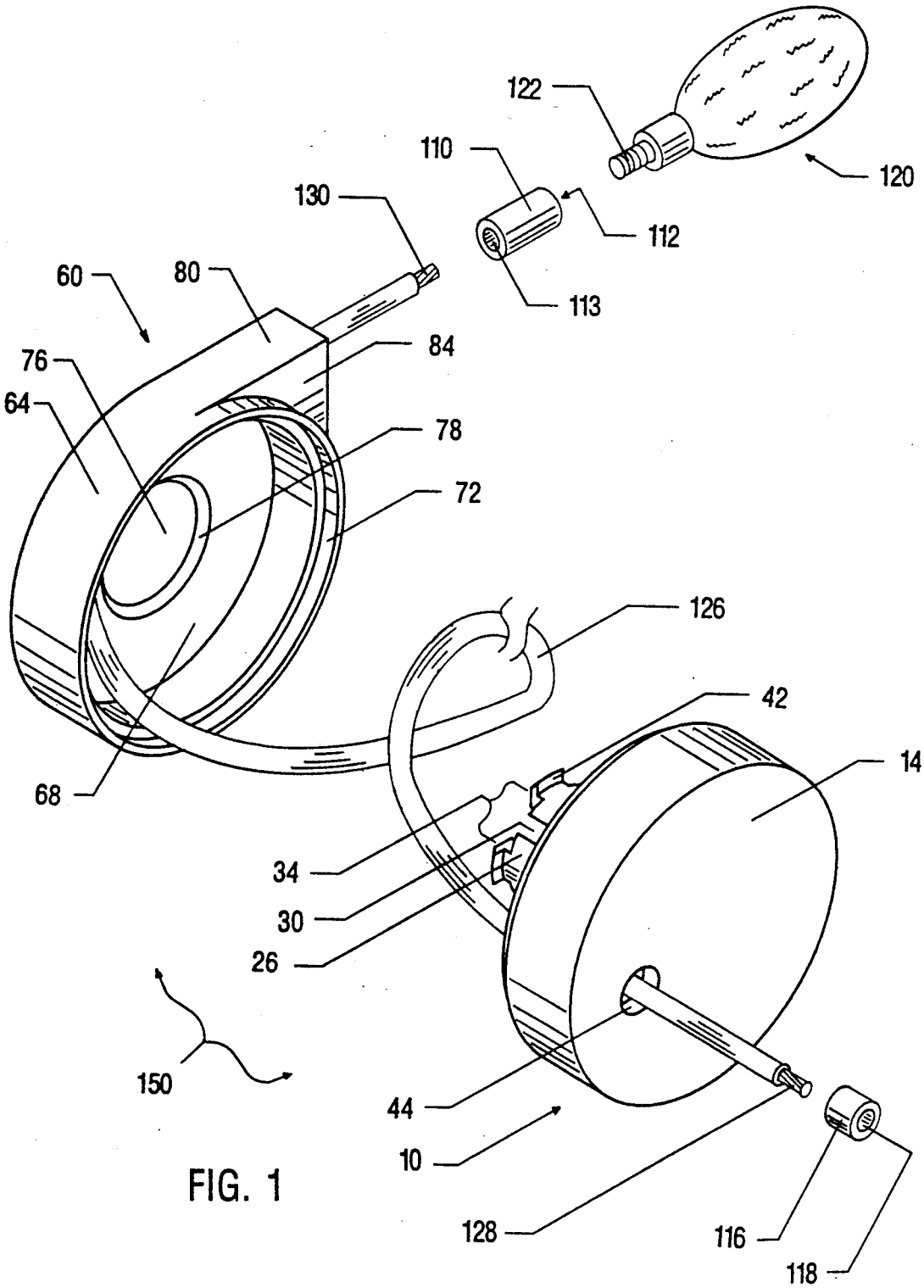
FIG. 1 shows how the invention is assembled, showing the inside of the female housing and the outside of the male housing.

A typical embodiment of my invention is shown in FIG. 1 as an assembly drawing. The invention is made up of an enclosed spool 150 which is comprised of a male housing 10 and a female housing 60, a wire rope 126, a connector 110 which will not scratch a gun barrel, a cleaning attachment 120 which is commonly available, and a retainer 116 which holds wire rope 126 to the enclosed spool.

Figure 2:
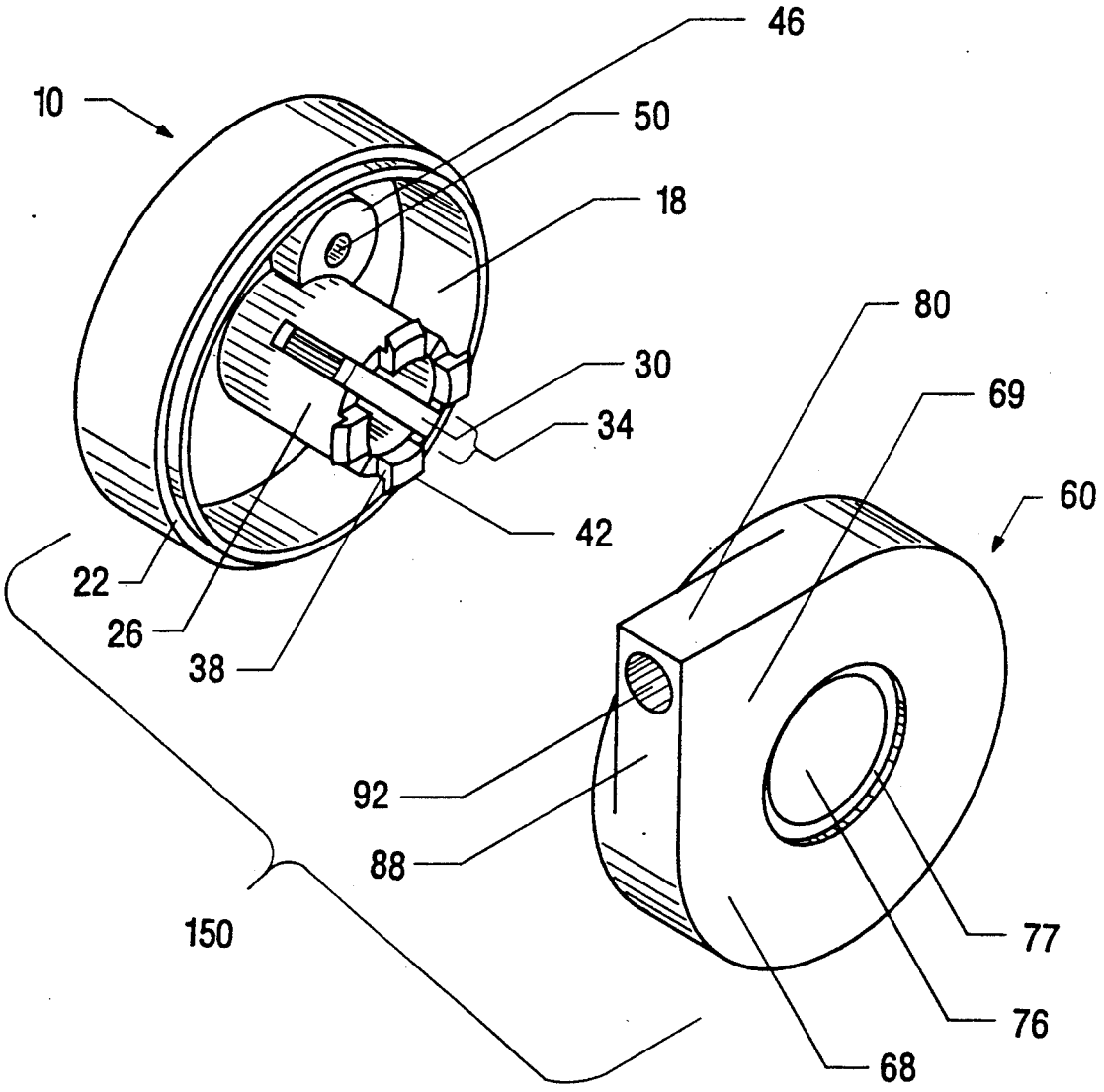
FIG. 2 shows the inside of the male housing and the outside of the female housing.

Connector 110 has internal threads 112 that run a partial length of connector 110 and an internal diameter 113 that runs the rest of the length of connector 110. This allows cleaning attachment 120 with external threads 122 to be threaded into connector 110. The other end of connector 110 is pushed over a stripped off length 130 of plastic coated wire rope 126 and is then crimped onto wire rope 126. The free end of wire rope 126 is then fed through an entrance cavern 92 (FIG. 2) and pathway 96 (FIG. 3) of female housing 60. Then the same end of wire rope 126 is fed through another pathway 50 (FIG. 2) and out a securing cavern 44 (FIG. 1) which is recessed in a back wall 14 of male housing 10. Retainer 116 is then pushed over another stripped off length 128 of the wire rope 126 and crimped onto wire rope 126 as before.

Enclosed spool 150 is made up of male housing 10 with basically two cylinders, cylinder wall 18 and barrel wall 26 (FIG. 2), projecting in the same direction from back wall 14, and female housing 60 with a tab entrance hole 76 cut out of a back wall 68 and a cylinder wall 64 projecting from back wall 68. This allows the two housing to be rotatably connected.

Barrel wall 26 has four thin slots 30 that are separated from one another and run most of the length of barrel wall 26. Four wide slots 34 which are centered as thin slots 30 and run a short length of barrel wall 26, are cut into barrel wall 26. Wide slots 34 show four tab supports 38 from which the four tabs 42 extend radially outward.

A lip 22 is formed by a tenon of diameter less than the outside diameter of cylinder wall 18 at the end of cylinder wall 18 which is farthest from back wall 14.

Male housing 10 has securing cavern 44 which is recessed into back wall 14 (FIG. 1). Since the depth of securing cavern 44 is greater than the thickness of back wall 14, a securing cavern wall 46 (FIG. 2) protrudes from back wall 14. Pathway 50 is cut of securing cavern wall 46 and is of smaller diameter than securing cavern 44 and has the same axial center.

Female housing 60 has cylinder wall 64 which projects from back wall 68. There is a squared off portion (FIG. 2) which is formed by a horizontal tangent wall 80 and a vertical tangent wall 88. Tangent walls 80 and 88 (FIG. 2) are tangent to the outside of cylinder wall 64 and meet each other forming a right angle. The widths of tangent walls 80 and 88, as measured in the direction along the axial center of cylinder wall 64 (FIG. 1), are equal to each other and less than the width of cylinder wall 64. Since a squared off portion of back wall 69 (FIG. 2) is flush with the rest of back wall 68 and the widths of tangent walls 80 and 88 are less than the width of cylinder wall 64 (FIG. 1), a front of squared off section 84 is recessed from the lip 72 side of cylinder wall 64. The outside portion of cylinder wall 64 runs a whole circle near the lip 72, but only runs three-fourths of a circle where the squared off portion formed by tangent walls 80 and 88 enclose cylinder wall 64. The inside of cylinder wall 64 runs an entire circle.

Lip 72 is formed by cutting a tenon out of the inside portion of the cylinder wall 64 around its circumference at the end of cylinder wall 64 which is farthest from back wall 68.

A tab entrance hole 76 is a circle that is concentric with cylinder wall 64 and is cut out of back wall 68. A tab retaining lip 77 is formed by cutting a notch into back wall 68 around the circumference of tab entrance hole 76. The notch is cut from the outside of female housing 60. An angled wall 78 (FIG. 3) is formed by cutting an angle into back wall 68 from the inside of female housing 60. Angled wall 78 forms an acute angle with tab retaining lip 77 for the circumference of tab entrance hole 76.

An entrance cavern 92 (FIG. 2) is recessed into vertical tangent wall 88 and has its axial center parallel to both horizontal tangent wall 80 and back wall 68. A pathway 96 (FIG. 3) is tangent to the inside of back wall 68 (FIG. 2) and tangent to the inside of cylinder wall 64 (FIG. 3) at the point where the outside of cylinder wall 64 meets horizontal tangent wall 80 (FIG. 1). With pathway 96 in this position, wire rope 126 can be wound up into its smallest volume because of the way the wire rope feeds into the spool. The incoming section of wire rope 126 will push the already enclosed wire rope toward the back wall 14 of male housing 10. If wire rope 126 enters enclosed spool 150 in any other place, the wire rope will overlap onto itself. This will cause the wire rope to bind up when it is being pulled out of the enclosed spool.

The axial center of entrance cavern 92 is positioned and the depth of entrance cavern 92 is chosen so that a connector stop 94 (FIG. 3) is formed by the remaining material in the squared off section of female housing 60. The largest portion of pathway 96 (FIG. 3) is opened due to the entrance cavern 92 intersecting with the inside of cylinder wall 64. Connector stop 94 is cut off at the open side of female housing 60 where the entrance cavern 92 intersects the inside of cylinder wall 64.

To understand the operation of this invention, a few dimensions must be defined in relation to each other. Lip 22 of male housing 10 is smaller in diameter than lip 72 of female housing 60. Barrel wall 26 is smaller in diameter than tab entrance hole 76. Wide slots 34 and thin slots 30 are wide enough and long enough to allow the tabs 42 to move radially inward enough to fit through tab entrance hole 76. Tab retaining lip 77 is of large enough diameter to allow the tabs 42 to spring back radially outward so that the tabs 42 catch on tab retaining lip 77. The tabs 42 are far enough away from back wall 14 so that when male housing 10 is pushed into female housing 60, lips 22 and 72 keep housings 10 and 60 aligned along their axial centers. Lips 22 and 72 are of the width along the axial direction so that housings 10 and 60 can only be pushed together far enough to allow the tabs 42 to catch on tab retaining lip 77.

Entrance cavern 92 is larger in diameter than connector 110. Connector stop 94 is of sufficient size to prevent connector 110 from entering the inside of cylinder wall 64 of female housing 60. Pathways 50 and 96 are large enough to allow wire rope 126 to pass through. Securing cavern 44 is of large enough diameter to allow retainer 116 to fit inside. Pathway 50 is of small enough diameter so that the securing cavern wall 46 will prevent retainer 116 from entering the inside of male housing 10. Connector 110 is of sufficient length to allow the external threads 122 of cleaning attachment 120 and some of wire rope 126 to fit inside. The internal diameters 112 and 118 are of sufficient diameter to allow the stripped off lengths 130 and 128 of wire rope 126 inside connector 110 and retainer 116 respectively.

OPERATION—FIGS. 1 TO 3

An important consideration during the design of this invention is the ability to manufacture it inexpensively by eliminating parts and labor. Therefore, a description of this invention's assembly is in order.

The plastic coating is stripped off of each end of wire rope 126. Then connector 110 is crimped onto one end of wire rope 126. The other end of the wire rope is threaded through the proper pathways 96 and then 50 so that both housings 10 and 60 can be held up by a person holding the other end of the wire rope. Then retainer 116 gets crimped on to the free end of wire rope 126.

Male housing 10 is then pushed to the other end of wire rope 126 so that retainer 116 moves into securing cavern 44. Then female housing 60 is pushed down wire rope 126 so that housings 10 and 60 are close together. Male housing 10 is lined up with female housing 60 so that their axial centers are the same. Then sufficient force is applied to snap the housings 10 and 60 together. During the snapping operation, the tabs 42 are guided into tab entrance hole 76 by angled wall 78. The tabs 42 prevent housings 10 and 60 from coming apart and the lips 22 and 72 prevent housings 10 and 60 from moving in a radial direction away from each other. This prevents the misalignment of their axial centers. When housings 10 and 60 are snapped together, the lips 22 and 72, cylinder walls 64 and 18, barrel wall 26, tab entrance hole 76 and tab retaining lip 72 are all concentric. This allows male housing 10 to turn while inside female housing 60. When male housing 10 is turned and female housing 60 is held stationary, the wire rope 126 is pulled in through entrance cavern 92 and wound into the inside of cylinder walls 64 and 18. The wire rope 126 can be pulled out of the enclosed spool 150 by holding female housing 60 stationary and pulling on cleaning attachment 120 that is threaded into connector 110.

A sportsman could use my invention in the following way: He would unload his gun and open the action, thus leaving the breech exposed. Then he would hold the gun with his left hand while retrieving the invention from his pocket with his right hand. While holding cleaning attachment 120 against the gun with his left forefinger and female housing 60 with his right thumb and forefinger, he would move the enclosed spool 150 away from cleaning attachment 120 by moving his right hand away from his left hand. When enough wire rope 126 has come out of enclosed spool 150 to travel the length of the gun barrel, he would drop housings 10 and 60 (which are snapped together) from his right hand. Now that enclosed spool 150 is hanging from cleaning attachment 120, he would grab cleaning attachment 120 with his right hand.

Then, by holding the gun with only his left hand, he would push (with his right hand) cleaning attachment 120 and wire rope 126 into the breech and down the barrel with short strokes until cleaning attachment 120 exits the barrel. Then, while holding the gun with his right hand, he would unscrew cleaning attachment 120 with his left hand. Then, while holding the gun and cleaning attachment 120 with his left hand, he would pull wire rope 126 back out of the gun. Since cleaning attachment 120 has been removed, no dirt will be pulled into the breech. Then, while holding the gun with his left forearm and right underarm, he could hold cleaning attachment 120 (while it is still detached from wire rope 126) and female housing 60 with his left hand and wind wire rope 126 back into enclosed spool 150 by turning the male housing 10 with his right hand. Then he would screw cleaning attachment 120 back into connector 110. Then, while holding the gun with his left hand, he would put the invention back into his pocket.

The above method of use is much easier practiced than described as suppose many simple tasks are. The above method of use is for clearing the plugged bore of a gun. My invention can also be used to pull a tightly fitting cleaning attachment, such as a bronze bristle brush, through the barrel. This way the barrel can be thoroughly cleaned by pushing the wire rope down the barrel and then fastening a cleaning attachment and pulling it through the barrel.

SUMMARY, RAMIFICATIONS AND SCOPE

From the preceding drawings and description of this invention, one can see that it will provide a compact, lightweight, and easy to use gun barrel cleaning device which does not require anything to be set on the ground to be used and emits no solvent odor.

The invention also lends itself to ease of manufacturability. The housings can be injection molded of plastic, such as acrylonitrile butadiene styrene, commonly called ABS, or other plastics. Ease of manufacturability helps keep the cost of the product down.

While my above description contains many specificities, these should not be construed as limitations on the scope of the invention, but rather as an exemplification of one preferred embodiment thereof. Many other variations are possible. For example, the wire rope may be secured anyplace on the male housing, the wire rope may be secured by another means to the male housing, the wire rope may enter the enclosed spool anywhere on the female housing, or the number of tabs may be altered. Another version resembling its mirror image may be produced. Accordingly, the scope of the invention should be determined not by the embodiments illustrated, but by the appended claims and their legal equivalents.

I claim:

1. A gun barrel cleaner comprising:

(a) an enclosed spool; and (b) an elongated flexible shaft, said shaft being pushable through the barrel of a gun;

said enclosed spool comprising:

(1) a female housing having an internal recess defining an open end, a closed end and a cylindrical wall, said cylindrical wall having entering means for allowing said shaft to pass through;

(2) a male housing having an internal annular recess defining an open end, a closed end and a cylindrical wall, said male housing further having securing means for attaching said flexible shaft to said mail housing;

(3) means for rotatably attaching said male housing to said female housing;

whereby said flexible shaft is pulled within said annular recess through said entering means and would upon said spool by rotating said male and female housings relative to one another.

2. The gun barrel cleaner of claim 1 wherein said enclosed spool consists of said housing.

3. The gun barrel cleaner of claim 1 wherein said shaft is a plastic coated wire rope.

4. The gun barrel cleaner of claim 3 wherein said wire rope is coated with nylon.

5. The gun barrel cleaner of claim 1, wherein the flexible shaft comprised means for attaching a cleaning tip.

6. The gun barrel cleaner of claim 1 wherein said enclosed spool is composed of plastic.

7. The gun barrel cleaner of claim 6 wherein said enclosed spool is composed of acrylonitrile butadiene styrene.

8. The gun barrel cleaner of claim 1, wherein said entering means is adjacent to the closed end of the female housing.

9. The gun barrel cleaner of claim 1 wherein said securing means is near the closed end of said male housing.

10. The gun barrel cleaner of claim 1, wherein said flexible shaft comprises a circular cross section.

11. A gun barrel cleaner comprising:

(a) an enclosed spool; and (b) an elongated flexible shaft having a cross sectional width, said cross sectional width located in a plane which is parallel to the surface upon which said flexible shaft is wound, said shaft being pushable through the barrel of a gun;

said enclosed spool comprising:

(1) a female housing having an internal recess defining an open end, a closed end and a cylindrical wall, said cylindrical wall having entering means for allowing said shaft to pass through;

(2) a male housing having a barrel wall extending laterally along an axis a distance which is at least two times the cross sectional width of the flexible shaft and means for securing the flexible shaft to the male housing at a distance which is at least one times said cross section width away from the female housing when assembled;

(3) means for rotatably attaching said male housing to said female housing;

whereby said flexible shaft is pulled through said entering means and wound upon said barrel wall by rotating said male and female housings relative to one another.

12. The gun barrel cleaner of claim 10 wherein said enclosed spool consists of said housings.

13. The gun barrel cleaner of claim 10 wherein said shaft is a plastic coated wire rope.

14. The gun barrel cleaner of claim 13 wherein said wire rope is coated with nylon.

15. The gun barrel cleaner of claim 11, wherein the flexible shaft comprises means for attaching a cleaning tip.

16. The gun barrel cleaner of claim 11 wherein said enclosed spool is composed of plastic.

17. The gun barrel cleaner of claim 16 wherein said enclosed spool is composed of acrylonitrile butadiene styrene.

18. The gun barrel cleaner of claim 11, wherein said entering means is adjacent to the closed end of the female housing.

19. The gun barrel cleaner of claim 11 wherein the male housing further comprises an internal recess defining an open end and a closed end and said flexible shaft being attached to said closed end.

20. The gun barrel cleaner of claim 11, wherein said flexible shaft comprises a circular cross section.

* * * * *